US008940986B1

(12) United States Patent
Edwards

(10) Patent No.: US 8,940,986 B1
(45) Date of Patent: Jan. 27, 2015

(54) TREMOLO AND BRIDGE DEVICE FOR STRINGED INSTRUMENTS

(71) Applicant: Nole F. Edwards, Yuma, AZ (US)

(72) Inventor: Nole F. Edwards, Yuma, AZ (US)

( * ) Notice: Subject to any disclaimer, the term of this patent is extended or adjusted under 35 U.S.C. 154(b) by 0 days.

(21) Appl. No.: 14/084,087

(22) Filed: Nov. 19, 2013

(51) Int. Cl.

| | |
|---|---|
| ***G10D 3/00*** | (2006.01) |
| ***G10D 3/04*** | (2006.01) |
| ***G10D 3/14*** | (2006.01) |
| ***G10D 1/08*** | (2006.01) |
| ***G10D 3/12*** | (2006.01) |

(52) U.S. Cl.
CPC ..... *G10D 3/146* (2013.01); *G10D 3/14* (2013.01); *G10D 3/143* (2013.01); *G10D 3/04* (2013.01); *G10D 3/12* (2013.01)
USPC ..... 84/313; 84/267; 84/298; 84/307; 84/312 R; 984/113; 984/121

(58) Field of Classification Search
CPC ..... G10D 3/143; G10D 3/04; G10D 3/14; G10D 3/146
USPC ..... 84/313, 267, 298, 307, 312 R; 984/113, 984/121
See application file for complete search history.

(56) References Cited

U.S. PATENT DOCUMENTS

| | | | | | |
|---|---|---|---|---|---|
| 2,741,146 | A | * | 4/1956 | Fender | 84/313 |
| 3,411,394 | A | * | 11/1968 | Jones | 84/313 |
| 4,171,661 | A | * | 10/1979 | Rose | 84/313 |
| 4,285,262 | A | * | 8/1981 | Scholz | 84/313 |
| 4,457,201 | A | * | 7/1984 | Storey | 84/313 |
| 4,487,100 | A | * | 12/1984 | Storey | 84/299 |
| 4,497,236 | A | * | 2/1985 | Rose | 84/298 |
| 4,512,232 | A | * | 4/1985 | Schaller | 84/313 |
| 4,549,461 | A | * | 10/1985 | Rose | 84/313 |
| 4,672,877 | A | * | 6/1987 | Hoshino et al. | 84/299 |
| 4,843,941 | A | * | 7/1989 | Nichols et al. | 83/313 |
| 4,955,275 | A | * | 9/1990 | Gunn | 84/313 |
| 5,196,641 | A | * | 3/1993 | Schaller | 84/740 |
| 5,413,019 | A | * | 5/1995 | Blanda, Jr. | 84/298 |
| 5,419,227 | A | * | 5/1995 | Lavineway | 84/313 |
| 5,429,028 | A | * | 7/1995 | Fisher, IV | 84/313 |
| 5,520,082 | A | * | 5/1996 | Armstrong et al. | 84/313 |
| 5,522,297 | A | * | 6/1996 | Enserink | 84/313 |
| 5,600,078 | A | * | 2/1997 | Edwards | 84/307 |
| 5,747,713 | A | * | 5/1998 | Clement | 84/313 |

(Continued)

OTHER PUBLICATIONS

Ganaden, Gerry, "Trem Wars: The Whammy Arms Race", Premiere Guitar Magazine, Mar. 17, 2009, pp. 1-12 Available at: http://www.premierguitar.com/articles/Trem_Wars_The_Whammy_Arms_Race.

*Primary Examiner* — Elvin G Enad
*Assistant Examiner* — Christina Russell
(74) *Attorney, Agent, or Firm* — Howard IP Law Group, PC

(57) ABSTRACT

A tremolo device for a stringed instrument is described in which a base plate is configured for surface mounting to a body of the instrument. A pivot plate is pivotally coupled to the base plate along an edge of the pivot plate. Each string is associated with a string seat. The string is threaded through the string seat receiving a terminal end of the string. The string seat includes a keyed portion that slidably attaches the string seat to the pivot plate in a keyed slot provided in a bottom surface of the pivot plate. A spring disposed between the base plate and the pivot plate maintains the pivot plate in a first position relative to the base plate until a user provides an action to pivot the pivot plate relative to said base plate. The spring returns the pivot plate to the first position when the user action is terminated.

20 Claims, 8 Drawing Sheets

(56) References Cited

U.S. PATENT DOCUMENTS

| | | | | |
|---|---|---|---|---|
| 5,986,190 | A * | 11/1999 | Wolff et al. | 84/297 R |
| 7,521,616 | B2 * | 4/2009 | Kahler | 84/313 |
| 8,748,717 | B2 * | 6/2014 | Mason | 84/298 |
| 8,779,258 | B2 * | 7/2014 | Lyles et al. | 84/297 R |
| 2003/0177883 | A1 * | 9/2003 | Rose et al. | 84/298 |
| 2004/0040432 | A1 * | 3/2004 | Erickson et al. | 84/306 |
| 2007/0214934 | A1 * | 9/2007 | Hendricks | 84/313 |
| 2008/0229898 | A1 * | 9/2008 | Steinberger | 84/298 |
| 2008/0229900 | A1 * | 9/2008 | Steinberger | 84/313 |
| 2012/0234155 | A1 * | 9/2012 | Finkle | 84/313 |

* cited by examiner 500
503
501
507

501
503
505

600
601
611
607
608

603
606
605
601
611
608

200
616
600
611
615
617
610
613
609

TREMOLO AND BRIDGE DEVICE FOR STRINGED INSTRUMENTS

FIELD OF THE INVENTION

The present application relates to stringed instruments. More particularly, the application relates to mechanical tone effects for stringed instruments.

BACKGROUND OF THE INVENTION

Stringed instruments such as a guitar include a body and a neck, which extends from the body. A set of strings is stretched across the body and longitudinally along over the neck. Each string terminates at a contact point on a bridge, and stretches the length of the neck terminating at a nut at the end of the neck where it meets the headstock. The point at which the string contacts the bridge and the point at which the string contacts the nut define a string length over which the string vibrates. The length of the string, along with the string tension define the pitch produced by the string's vibration.

The neck of the instrument may have frets disposed on its surface defining raised lines that are generally parallel to the nut (i.e. transverse to the longitudinal axis of the neck). A player presses down on the strings until the string contacts one of the frets. When the string contacts the fret, it defines a new string length between the bridge and the fret which is shorter than the distance between the bridge and the nut. Plucking or strumming the string will produce a pitch higher than the pitch of the open string, and the player can thereby control the notes created from the instrument.

Other properties relating to pitch may be manipulated by the player by controlling the length and tension of the strings. For example, bending is a fingering technique whereby a player presses down on a string at a given fret and then pushes up or down transverse to the neck (e.g. bends the string) to increase the tension on the string at the fret. This produces a higher pitch sound than the sound of an undeformed string at the same fret. By bending strings, the player can transition from the base note to a higher note in a gradual manner without having to pluck or strum the second note. While bending can create a higher pitched note, there is not a way of manipulating strings at the frets to produce a lower pitch. Lowering the pitch requires lengthening the string or reducing the tension of the string, which cannot be performed by the player on the fret board through fingering techniques.

To produce an effect of lower pitch, tremolo devices have been developed which modify or move the bridge of the instrument to allow the player to control the tension of the string to a limited degree. By moving the bridge such that the termination point of the string at the bridge moves closer to the neck, the tension of the string is reduced and the pitch of the resultant note is lowered. Thus, the tremolo device produces a vibrato effect, allowing the player to oscillate through varying frequencies and producing a varying pitch within a sustained note. Traditional tremolo devices incorporate a plate which holds the bridge device. The plate typically has an edge which serves as a pivot fulcrum. A lever handle is attached to the plate, allowing the player to move the handle to pivot the plate along its fulcrum edge. The pivoting of the plate moves the bridge closer to or further from the neck to vary the tension of the strings. Other tremolo devices use cylindrical cams at the bridge over which the strings are stretched. The cam is rotated to vary the point where the string makes contact with the cam to adjust the length and tension of the string. Conventional tremolo devices may require openings or routing paths in the guitar body to allow the bridge mechanism to pivot and to provide counterbalancing springs to bring the tremolo device back to its original undeployed position.

One well-known problem with tremolo devices is that once the tremolo device is deployed, the string does not return to the exact pitch that it had prior to using the tremolo device (e.g. the string is out of tune). Accordingly, a player may tune the instrument to bring the set of strings into tune, and begin playing. While playing, the player deploys the tremolo device that moves the bridge to increase or reduce the tension on one or more of the strings. This causes the string to slide at the contact points at the bridge and/or the nut. Seldom does the string return to the exact seated position that it held prior to using the tremolo and therefore, the string falls out of tune. In addition, each string in a set of strings has a different gauge or diameter. When the tremolo device moves the bridge, it applies an equal force or movement to all strings in the set. Because of their different sizes, the force affects each string slightly differently, which may cause the strings to fall slightly out of tune relative to one another.

Alternative structures and techniques are desired.

SUMMARY

A tremolo device for a stringed instrument is described in which a base plate is configured for surface mounting to a body of the instrument. A pivot plate pivotally coupled to the base plate along an edge of the pivot plate. Each string is associated with a string seat. The string is threaded through the string seat which has a tapered notch for receiving a terminal end of the string. The string seat includes a keyed portion that slidably attaches the string seat to the pivot plate in a keyed slot provided in a bottom surface of the pivot plate. A spring disposed between the base plate and the pivot plate maintains the pivot plate in a first position relative to the base plate until a user provides an action to pivot the pivot plate relative to said base plate. The spring returns the pivot plate to the first position when the user action is terminated. As the pivot plate pivots, the string seat engaged in the pivot plate moves the terminal end of the string closer to the neck of the instrument, thereby relaxing the tension of the string to produce a lower pitch.

The tremolo device includes an upper pivot block coupled to the pivot plate and a lower pivot block coupled to the base plate. The upper pivot block is configured to receive a tremolo arm. The tremolo arm provides a user with leverage to pivot the pivot plate relative to the base plate. A compensating screw connects the upper pivot block and the lower pivot block. The compensating screw may be threaded through a first bearing inserted in the upper pivot block and a second bearing inserted in the lower pivot block. The compensating screw may further be configured to be threaded in a first thread direction at said first bearing and in a second thread direction opposing said first thread direction at said second bearing.

An intonation adjustment screw may be provided to threadingly engage the keyed portion of the string seat along the keyed slot of said pivot plate. Turning said intonation adjustment screw causes the string seat to slide along the longitudinal axis of said intonation adjustment screw along said keyed slot to provide an intonation adjustment by lengthening or shortening the length of the string.

A set of gauged rollers, each gauged roller corresponding to one string of the stringed instrument, may be provided having a rotational axis which is aligned with a pivot axis between said pivot plate and said base plate. A string of the stringed instrument extends from a string seat under a corresponding gauged roller having a groove about its perimeter, the groove having a size configured to receive the string and based on the gauge of the associated string.

The tremolo device may further include a bridge mounting section configured to receive a bridge assembly between said pivot plate and a neck of the stringed instrument. The bridge mounting section includes at least one keyed slot configured to receive a string saddle corresponding to one string of the stringed instrument. The string saddle has a first member configured to receive a gauged roller, said gauged roller having a rotational axis perpendicular to a direction of the corresponding string and having a groove about its perimeter, said groove having a size configured to receive the corresponding string and having a keyed section and a second member having a keyed slot configured to receive said keyed section of said first member and slidingly engage said first member, said second member having a sloped surface at said keyed slot, wherein upon the first member sliding along said keyed slot causes a height of said string saddle relative to said base plate to change.

DETAILED DESCRIPTION

Figure 10:
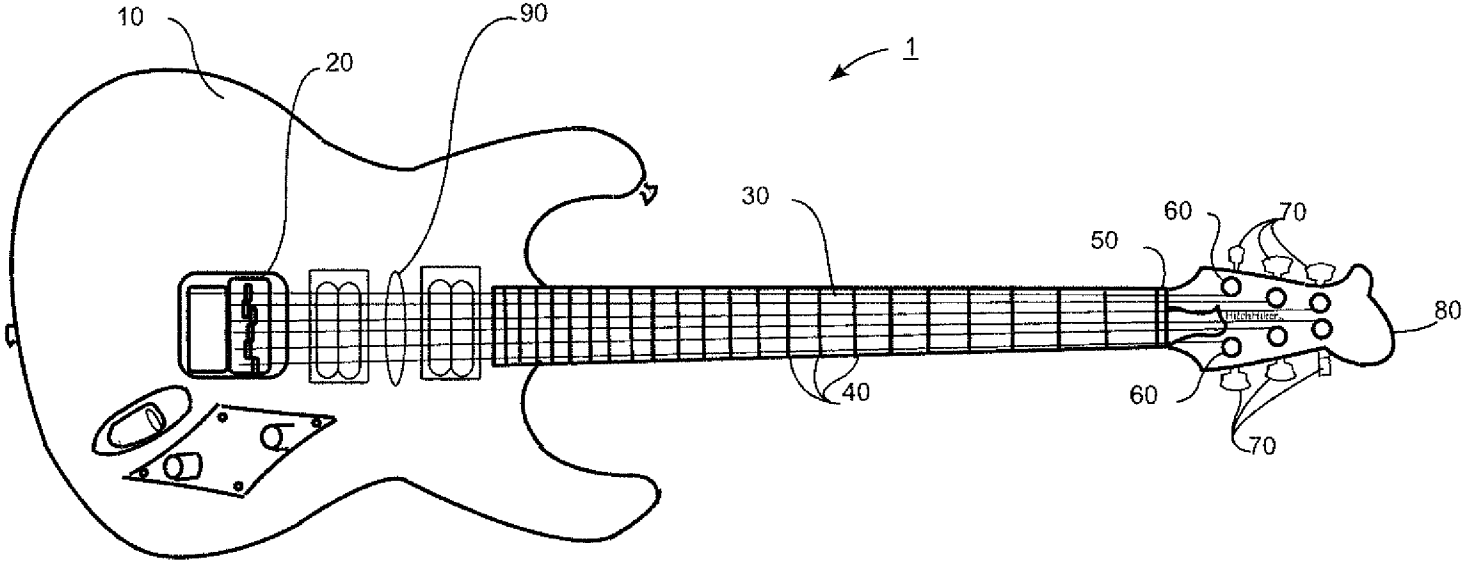
FIG. 10 prior art
FIG. 10 is an illustration of a string instrument as known in the art.

An example of a stringed instrument 1 is shown in FIG. 10. The instrument 1 includes a body 10, which may be formed of a substantially solid material, or may be partially or entirely hollow. The body 10 may be made of wood or other material of sufficient hardness. The body 10 of the instrument provides the musician a location for interaction between the musician and the strings 90. For example, the musician will generally hold the body or have the body suspended from a strap in front of the musician. The musician plucks or strums the strings 90 in an area where the strings are stretched across the body 10 between the bridge 20 and the neck 30 of the instrument 1. One end of the strings 90 is situated proximal to the bridge 20. The bridge 20 provides a contact point with the strings 90 which define an endpoint to the string when the string vibrates. The strings 90 extend from the bridge 20 along the neck 30 of the instrument and contact a nut 50 at the end of the neck opposite the bridge. Along the neck 30, a number of raised bars called frets 40 are positioned generally perpendicular to the direction of the strings 90. The strings extend past the nut 50 and are wrapped around a corresponding tuning peg 60. Each tuning peg 60 is coupled to a tuner 70 which rotates the tuning peg 60 when the tuner 70 is turned by the musician. The tuning pegs 60 and tuners 70 are located on a structure extending from the neck 30, which is known as the headstock 80.

The musician may control the length of a selected string 90 by pressing the string 90 down at a position along the neck 30 defined by a selected fret 40. When the string 90 is depressed toward the neck 30, the string 90 contacts the fret 40 closest the point of contact between the musician's finger and the bridge 20. When the selected string is plucked or strummed, the string 90 vibrates between the contact point on the bridge 20. When a string is not depressed by the musician and the string is plucked or strummed (known as open string or open position), the string 90 vibrates for a length defined by the contact point at the bridge 20 and the contact point at the nut 50. The length of the vibrating portion of the string determines the pitch of sound the string will create. Thus, the instrument 1 is capable of producing any pitch or note within the range of the lowest string in an open position and the highest string at the fret 40 closest to the bridge 20.

Using frets 40 allows the musician to produce a series of incremental pitches defined by the distances between each fret 40. However, there are times when it is desired to create tones or pitches that exist between the increments defined by the frets 40. In addition to controlling the length of the vibrating string, the tension of the string also affects the pitch produced. When tension increases, the pitch increases, or produces a higher note. When tension is relaxed, the pitch decreases or produces a lower note. By affecting the tension of the string, the musician can produce notes and sound effects that are not achievable through the conventional "fretting" of the strings. To increase tension, the musician may depress a selected string 109 and simultaneously "bend" the string by providing an upward or downward pushing of the string, transverse to the string direction. In order to produce a lower pitch, or relax the tension of a string, tremolo devices have been developed. Tremolo devices operate by providing a mechanism by which the bridge 20 is moveable. When the bridge 20 is moved in a direction toward the neck 30 of the instrument 1, the tension of all the strings 90 is relaxed and the pitch decreases. Tremolo devices generally include a handle or arm which provides the musician with leverage to effect the movement of the bridge 20, generally against a counter-force produce by a spring.

Tremolo devices suffer from known problems, such as placing the strings out of tune when the tremolo device is used, or requiring routing or holes to be cut into the instrument body to accommodate the tremolo device. The tremolo and bridge device described herein address these problems by providing a surface-mountable tremolo device which reduces or eliminates friction at the contact points of the strings when the tremolo is used, thereby allowing the strings to return to their original position and stay in tune.

Figure 1A:
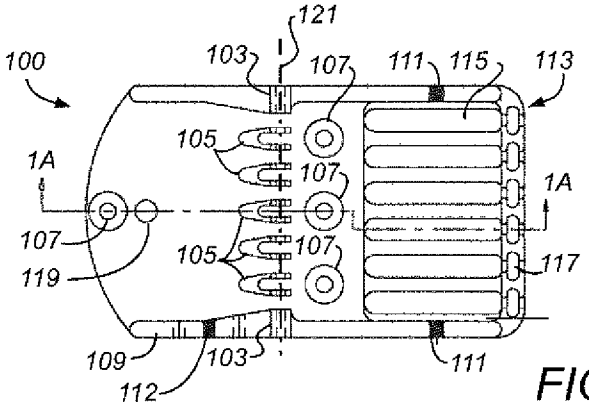
FIG. 1A and FIG. 1B is a plan and cross-sectional view, respectively, of a base plate of a tremolo device according to an embodiment of the invention.

FIG. 1A is a plan view of a base plate 100 for use with a tremolo device according to an embodiment of the invention. It should be noted, that the description herein makes reference to an embodiment designed for a six-string guitar, however the tremolo device is not limited thereto. One of skill in the art of stringed instruments will understand that the tremolo device could easily be modified for use with any musical stringed instrument using any number of strings. For simplicity, the accompanying description will refer to stringed instrument as a guitar, and will refer to a conventional accompaniment of six strings.

The base plate 100 is formed having a planar lower side 101 adapted to contact the body of the guitar near the bridge. In an embodiment, a bridge mount section 113 is included in the base plate 100 for mounting a bridge assembly to the base plate as will be described in greater detail herein. It should be understood that the planar lower side 101 may not be perfectly planar, but will follow the contour of the guitar body to allow for a secure surface mounting of the base plate 100. For example, an arch body guitar may require the surface of the planar lower side 101 to be slightly convex in order to conform to the shape of the body of the guitar at its bridge area. Other guitar body contours may be conceived which may require slight modifications of the lower side 101 of the base plate 100 to provide for a good surface mount. Thus, the planar lower side 101 is substantially planar in that the lower surface conforms to the surface of the guitar body at its areas of contact.

Figure 1B:
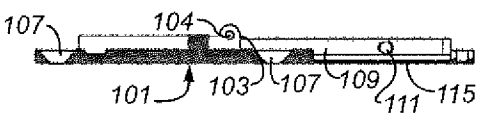

Base plate 100 has one or more beveled screw holes 107 disposed through the cross-sectional extent of the base plate 100. Suitable fasteners, such as wood screws or the like, may be inserted through the holes 107 and extend into the body of the guitar in order to surface mount the base plate 100 to the guitar. Along the longitudinal edges of the base plate 100, side walls 109 are formed. The side walls 109 are substantially perpendicular to the planar lower side 101 and provide a surface for attaching other components to the base plate. Threaded apertures 111, 112 are disposed in the outer surface of side walls 109 and allow attachment of various components. For example, the lower pivot block shown in FIG. 5B may be attached at aperture 112, and a bridge assembly may be fixedly attached to the base plate 100 at apertures 111. Side walls 109 further include a pair of hinge knuckles 103 which are aligned with each other to define a pivotal axis through apertures 104. A set of stirrup-shaped hinge knuckles 105 are disposed on the base plate and each stirrup-shaped knuckle 105 defines a pair of apertures aligned with the pivotal axis. The strings of the instrument pass between the stirrup-shaped hinge knuckles 105 and at positions above and below the outermost stirrup-shaped hinge knuckles 105. Thus, the number of stirrup-shaped hinge knuckles 105 is equal to n−1, where n is the number of strings on the instrument. In the embodiment of FIG. 1A and FIG. 1B, designed for a six-string guitar, there are five stirrup-shaped hinge knuckles 105. The space between the apertures defined by each stirrup-shaped knuckle 105 is configured to receive a corresponding hinge knuckle of a pivot plate (203, shown in FIG. 2A).

Base plate 100 further defines a bridge mount section 113, which is configured to attach the bridge of the guitar to the base plate 100. The bridge mount section 113 is defined by a recessed region in base plate 100 which includes a number of channels 115 defined longitudinally along base plate 100 in the direction of the strings. The channels 115 receive bridge saddles (700, shown in FIG. 7A) which provide contact points for one end of the string which further extends from the bridge to the nut at the end of the neck near the headstock. A threaded adjustment screw (not shown) may extend longitudinally and engage a threaded aperture defined in each bridge saddle to provide intonation or height adjustments. A series of recesses 117 are defined to accommodate the heads of the adjustment screws and to encapsulate the head of the adjustment screws. When the user turns the head of the adjustment screw using an appropriate tool (e.g. wrench), the rotation of the adjustment screw causes linear movement of the bridge saddle along the string path. As the saddle moves along the string path, the distance between the bridge saddle and the nut of the guitar increases or decreases based on the direction the adjustment screw is rotated. Thus, the effective length of the string changes. Changing the length of the string allows for harmonic tuning of the string, referred to as "intonation". Additional adjustments may be incorporated into the bridge saddle, such as string height adjustments. An example of an adjustable bridge which may be used in conjunction with the base plate 100 of FIG. 1 is shown and described in U.S. Pat. No. 5,600,078 issued on Feb. 4, 1997 to Nole F. Edwards, which is incorporated by reference herein in its entirety.

Figures 2A, 2B, 2C:
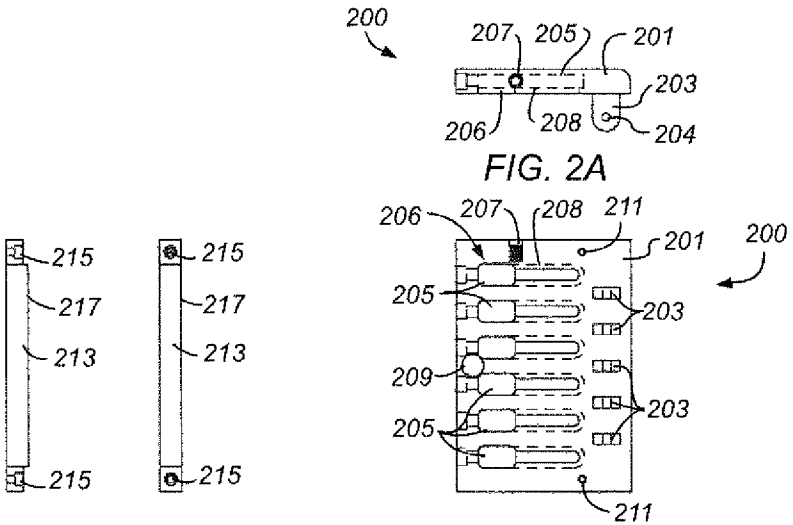
FIG. 2A, FIG. 2B and FIG. 2C is a plan and elevation view of a pivot plate of a tremolo device according to an embodiment of the invention.

The base plate 100 works in conjunction with the pivot plate 200 of FIG. 2A to allow the user to reduce the tension of the strings to produce a tremolo effect. The pivot plate 200 engages the pivot axis 121 of the base plate 100 to create a pivotal motion of the pivot plate 200 with respect to the base plate 100. The string ends are attached to the pivot plate 200 and move to reduce the string tension when the rear of the pivot plate opposite the hinge is depressed. A spring (not shown) is placed in spring seat 119 of the base plate and provides an upward force on the pivot plate 200 to return the pivot plate to its original position relative to the base plate 100. As will be described in greater detail below, the force produced by the strings, urges the pivot plate 200 downward, while the spring urges the pivot plate 200 upward to counterbalance the string tension.

Referring now to FIGS. 2A, 2B, and 2C, a pivot plate 200 according to an embodiment of this disclosure is shown. FIG. 2A is a side elevation view of the pivot plate 200, while FIG. 2B is a plan view of the underside of the pivot plate 200. That is, the side of the pivot plate facing the guitar body when the pivot plate 200 is used as part of a tremolo device according to an embodiment of the invention. The pivot plate 200 includes a body 201 which may be a substantially rectangular block of material thick enough to receive a keyed portion of a plurality of string seats (shown in FIG. 3A) into a corresponding keyed slot 205 cut into the under surface of the pivot plate body 201. Extending from the underside of the pivot plate 200 are a plurality of hinge knuckles 203 which insert between the pair of hinge knuckles defined by each stirrup-shaped hinge knuckle (105, shown in FIG. 1A) on the base plate 100. When the pivot plate hinge knuckles 203 are inserted in the stirrup-shaped knuckles 105, apertures 204 in the hinge knuckles 203 align with apertures 104 on the base plate 100. A rod or pin (not shown) is inserted through the apertures 104, 204 along the pivot axis (121, shown in FIG. 1A) to complete the hinge or pivot. Spring seat 209 corresponds with spring seat 119 (shown in FIG. 1) and is configured for receiving a spring (not shown) to maintain an upward force on pivot plate 200 relative to the base plate. Keyed slots 205 are configured to receive a keyed portion of a string seat (300 shown in FIG. 3A). Therefore, a keyed slot 205 is provided for each string. Each keyed slot 205 includes an enlarged opening 206 facing the underside of the pivot plate 200 which allows the string seat 300 to be inserted into the pivot plate 200. The keyed portion of the string seat 300 then slides into an enclosed groove 208 defining a channel which allows the string seat 300 to slide along the keyed slot 205 without coming out of the pivot plate 200.

Figure 8:
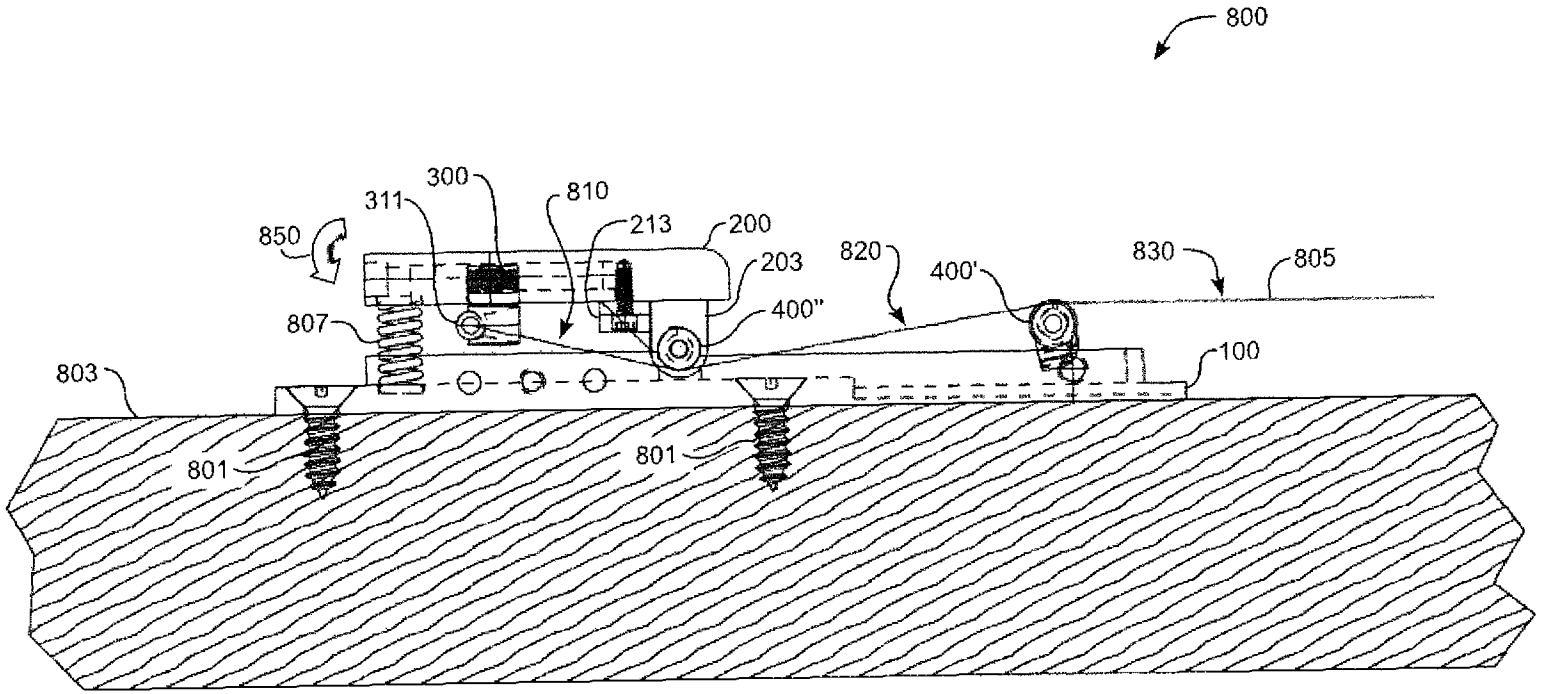
FIG. 8 is an elevation view of a tremolo device and bridge in phantom according to an embodiment of the invention.

A string deflector 213 may be mounted into onto pivot plate 200 by screws (not shown) via screw holes 215, which align with apertures 211 in pivot plate 200. The string deflector 213 includes a bar-shaped body portion 217 which extends from the underside of the pivot plate 200. When replacing or installing strings, one end of the string has a terminal end, such as a brass ball or ring around which the end of the string is wrapped and twisted. The opposite end of the string is threaded through the string seat 300 and directed through the bridge mechanism, along the neck over the nut and attached to a tuning peg at the guitar's headstock. The string deflector 213 deflects the string downward as it is being threaded as shown in FIG. 8. This allows the string to be easily guided along the proper string path under the pivot plate 200 and hinge pivot axis 121 before extending over the bridge saddle.

The pivot plate 200 has a threaded aperture 207 defined in its side, which allows attachment of a component for applying leveraging force to the pivot plate 200 to cause the pivot plate 200 to pivot relative to the base plate 100. For example, an upper pivot block (600, shown in FIG. 6) may be attached to the pivot plate 200 by way of a threaded fastener threaded into threaded aperture 207 as will be explained in greater detail below.

Figure 3A:
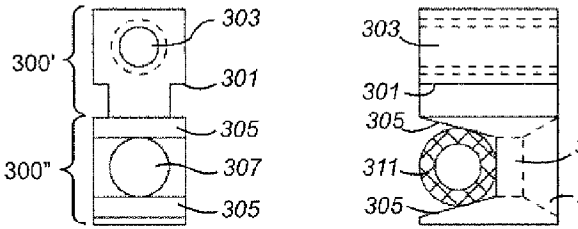
FIG. 3A and FIG. 3B are an elevation front and side views, respectively, of a string seat for use with a tremolo device according to an embodiment of the invention.
Figure 3B:
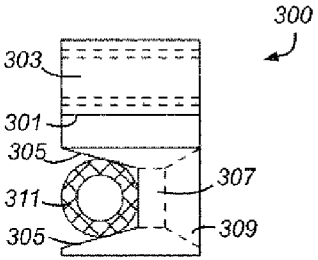

Referring now to FIG. 3A and FIG. 3B, a string seat 300 configured to mate with the keyed slot (205, shown in FIG. 2B) is shown. The string seat 300 comprises two primary sections 300' and 300". The first section 300' provides for attachment of the string seat 300 to the pivot plate (200, shown in FIG. 2B). A keyed portion 301 is configured to mate with the keyed slot 205 disposed in the underside of the pivot plate 200. The keyed portion 301 engages the keyed slot 205 and is slidably attached to the pivot plate 200 via the keyed slot 205. The string seat 300 is therefore adjustable and provides an additional harmonic tuning, or intonation adjustment by allowing the length of the string to be varied at the tremolo device in addition to an intonation adjustment at the bridge. The string seat 300 may be moved via a threaded rod (not shown) which passes through a threaded aperture 303. The head of the threaded rod may be accessed through a hole disposed in the end of the pivot plate and may be accessed by an appropriate tool, such as an Allen's wrench. Based on the direction the threaded rod is turned, the string seat 300 will move longitudinally along with the end of the string closer to or farther from the bridge to adjust the length of the string.

The second section 300" of the string seat 300 is the seat for the string itself. Guitar strings generally are terminated at one end by a metal ball or ring 311. The string end is wrapped around the ball or ring 311 and twisted to secure the string end to the ball or ring 311. The string seat 300 includes a tapered notch 305 which allows for the ball or ring 311 to be seated in notch 305. A string hole 307 passes through the string seat 300 and provides a flared opening 309 on the side of the string seat 300 opposite the tapered notch 305. To install or replace a string, the end of the string opposite the ball or ring 311 is threaded through the string hole 307 and directed under the hinge of the tremolo device, extending to the bridge saddle. The full length of the string is threaded through the string seat 300 until the ball or ring 311 contacts the string seat 300 and is seated in the tapered notch 305. The flared opening 309 allows for the string to pass through the string seat 300 at an angle whereby no stress or friction between the string and the string seat 300 is created by the string touching the string seat 300 at the flared opening 309. For example, according to one embodiment, the flared opening 309 may define an opening which extends at 60°, providing a 30° deflection angle from a center line in an upward and a downward direction. The flared opening 309 may be designed having other angles, which allow for the string to pass through the string hole 307 at an angle without the string contacting the string seat 300 other than at the ball or ring 311 at the string end.

Figure 4:
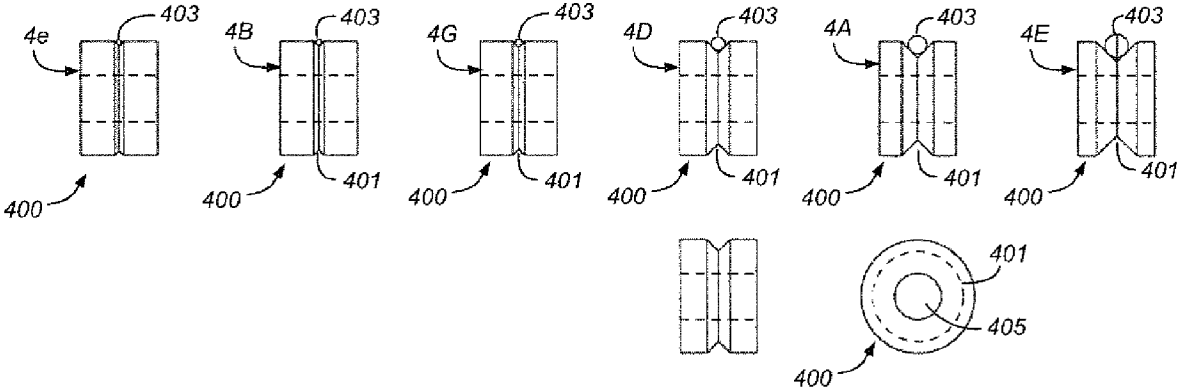
FIG. 4 is an elevation view of a set of gauged rollers for use with a tremolo device and/or bridge assembly according to an embodiment of the invention.

FIG. 4 shows a set of gauged rollers used in an embodiment of the tremolo device of this disclosure. Rollers 400 are generally cylindrical in shape having an aperture 405 defined along its longitudinal axis. Circumferentially about the perimeter of each roller 400, a groove 401 is defined which is sized to accommodate a string of a specific gauge or diameter. The string 403 contacts the roller 400 at a point substantially tangent to the roller's 400 circumference and rests in the groove 401. The rollers 400 define a set where a roller 400 is provided for each string of the stringed instrument. The set of rollers 400 shown in FIG. 4 is designed for a standard tuned six-string guitar. Therefore, grooves 401 are provided which would correspond to the string gauges of the guitar. As may be seen in FIG. 4, a guitar using standard tuning would use a set of rollers 400 having a roller 4E having a groove 401 designed to hold the sixth string, or low E. Roller 4A has a groove 401 which would accommodate a string having a gauge corresponding to the fifth string, or A string. Roller 4D has a groove 401 for accommodating the string gauge of the D string. Roller 4G has a groove 401 for accommodating the string gauge of the G string. Roller 4B has a groove 401 for accommodating the string gauge of the B string, and roller 4*e* has a groove 401 for accommodating the first string, or the high E string. The rollers 400 may be provided having grooves 401, which correspond to the string gauge of any stringed instrument for any number of strings and are not limited only to a six-string guitar.

Two sets of rollers 400 may be provided in a tremolo device according to an embodiment of the invention. A first set of rollers 400 is provided at the bridge saddle, providing a string contact point at the bridge. Each roller 400 is designed for the gauge of its corresponding string such that when the tension of the string is varied, by operating of the tremolo device, or by the tuning pegs or intonation adjustments, friction is reduced at the point of contact between the string and the bridge due to the rollers 400. A corresponding second set of rollers 400 is provided in the tremolo device at the hinge between the base plate 100 and the pivot plate 200. Referring again to FIG. 1A, the base plate 100 includes a set of stirrup shaped hinge knuckles 105 which receive the corresponding hinge knuckles (203, shown in FIG. 2A) of the pivot plate 200. Between the stirrup-shaped hinged knuckles 105, a set of rollers 400 may be installed such that the roller aperture 405 is aligned with the pivot axis of the base plate 100 and the pivot plate 200. The strings are directed from the string seat 300, under the second set of rollers 400 and then extend to the first set of rollers 400 at the bridge. The string path through the rollers 400 will be described in greater detail below with respect to FIG. 8.

Figures 5A, 5B, 6A, 6B, 6C:
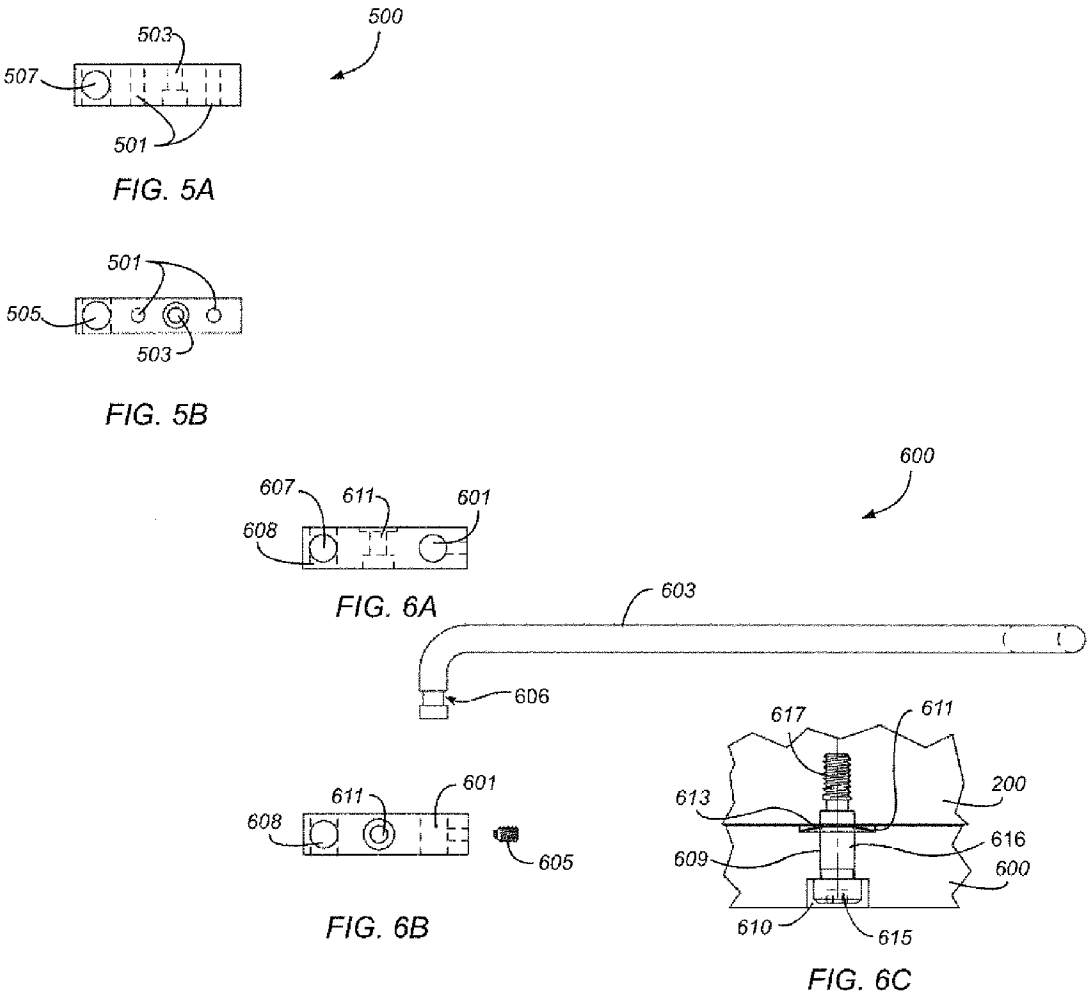
FIG. 5A and FIG. 5B are plan and elevation views, respectively, of a lower pivot block for use in a tremolo device according to an embodiment of the invention.
FIG. 6A and FIG. 6B are plan and elevation views, respectively, of an upper pivot block and tremolo arm of a tremolo device according to an embodiment of the invention.
FIG. 6C is a cross-sectional view of a shouldered screw for mounting the upper pivot block to the pivot plate of a tremolo device according to an embodiment of the invention.

FIG. 5A shows a plan view of a lower pivot block 500 which attaches to the base plate 100 shown in FIG. 1. FIG. 5B is an elevation view of the lower pivot block 500 of FIG. 5A. The lower pivot block 500 attaches to the base plate 100 by way of a screw via threaded aperture 503. Additional apertures 501 are provided which align with holes in the base plate 100 to receive a dowel or pin to prevent rotational movement of the lower pivot block 500. A bearing 505 may be inserted into an aperture, the bearing 505 having a threaded hole through the bearing 505 perpendicular to the direction the bearing 505 is inserted into the lower pivot block 500. An adjustment screw hole 507 is drilled perpendicular to the longitudinal dimension of bearing 505 and aligned with the threaded hole in the bearing 505. A compensating screw (not shown) may be provided which is threaded into the threaded hole in the bearing 505 and extends through a similar bearing installed in the upper pivot block (608, shown in FIG. 6A). In this mariner, the upper and lower pivot blocks 600, 500 are linked through the compensating screw. The compensating screw allows the player to choose the height of the tremolo arm relative to the guitar body to suit the player's picking hand position and make gripping the tremolo arm convenient from a normal playing position.

FIG. 6A and FIG. 6B show an upper pivot block 600 according to an embodiment of the tremolo device. The upper pivot block 600 is shown in a plan view in FIG. 6A, and from a perspective looking down at the tremolo device toward the body of the guitar. FIG. 6B is an elevation view showing the side of the upper pivot block 600 which would be visible when looking downward at the instrument as the instrument is being played. An aperture 601 is provided which receives the tremolo arm (603 shown in FIG. 6A), which provides the player leverage to move the upper pivot block, which causes the pivot plate 200 to pivot relative to the base plate 100. A set screw 605 is provided to hold the tremolo arm 603 securely in the upper pivot block 600. A channel 606 may be carved into the tremolo arm 603 to hold the set screw 605 while still allowing rotational movement of the tremolo arm 603 within aperture 601. A second adjustment hole 607 receives a compensating screw (not shown), which is threaded through a threaded hole disposed in a bearing inserted into bearing hole 608. The bearing 607 is designed to be a slip fit into bearing hole 608, and allows rotational movement of the bearing 607, but does not allow translational movement. A snug fit of the bearing prevents unwanted vibration in the bearing as the guitar is being played. A mounting hole 609 is provided for mounting the upper pivot block 600 to the pivot plate 200.

FIG. 6B is a cross-sectional view in phantom of the mounting of the upper pivot block to the pivot plate. Mounting hole 609 traverses the cross sectional extent of upper pivot block 600. A countersunk hole 610 having a diameter greater than the diameter of the mounting hole 609 is configured to accommodate the head of shouldered screw 615. The shoulder 616 of shouldered screw 615 fits snugly in mounting hole 609 but allows the upper pivot block 600 to pivot about shouldered screw 615. The threaded portion 617 of the shouldered screw 615 engages with the threaded aperture (207, shown in FIG. 2) in the pivot plate 200 and secures the upper pivot block 600 to the pivot plate 200. A small recess 611 is placed in the upper pivot block 600 along the side abutting the pivot plate 200. The recess 611 receives a spring mechanism, for example, a Belleville washer 613, which provides a force between the recess 611, and the surface of the pivot plate 200 to maintain tension on the upper pivot block 600 to prevent vibration and to help maintain the tremolo arm in a given position.

Figure 7B:
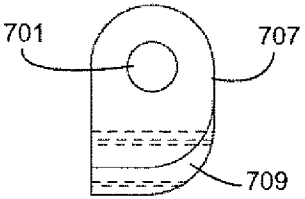
FIG. 7A and FIG. 7B are front and side elevation views, respectively, of a string saddle for a bridge assembly of a tremolo device and bridge in accordance with an embodiment of the invention.
Figure 7A:
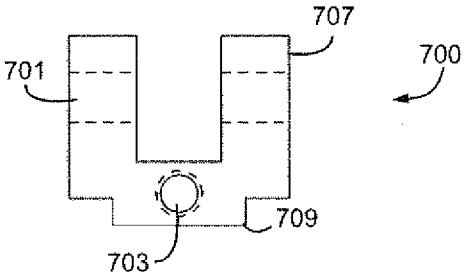

FIG. 7A and FIG. 7B provide illustration of a bridge saddle 700 adapted for use with a set of gauged rollers 400 of FIG. 4. The bridge saddle 700 has a stirrup-shaped body 707 having an aperture 701 defined through the arms of the stirrup in a direction transverse to the string direction across the bridge saddle 700. A set of gauged rollers 4E, 4A, 4D, 4G, 4B, and 4*e* fit within the stirrup and apertures in the rollers 400 align with the aperture 701 in the bridge saddle 700. At the lower portion of the body 707, a threaded aperture 703 is provided which serves as a height adjustment for the bridge saddle 700. The bridge saddle 700 includes a keyed portion 709 which engages a slot defined in a second bridge member (not shown) adjustable longitudinally along the string path and having a sloped upper surface containing the slot into which the keyed portion 709 of the bridge saddle 700 seats. An adjustment screw passes through the threaded aperture 703. When the adjustment screw is turned, it causes the bridge saddle 700 to slide in the groove along the sloped surface of the other bridge member, causing the bridge saddle 700 to raise or lower, which adjusts the string height at the bridge for adjusting the action of the instrument.

FIG. 8 is an elevation view of a tremolo device 800 showing some components of the device in phantom and having some components omitted to better illustrate certain details. The body 803 of the instrument may generally be a solid material, such as wood. The tremolo device 800 may be surface mounted on the instrument body 803 via wood screws 801 without any routing or cutting necessary in the instrument body 803. The base plate 100 is secured to the body 803 by the wood screws 801 and achieves a tremolo effect via the pivot plate 200, and the bridge mounted on bridge mount section 113. It will be noted that the upper pivot block 600, including the tremolo arm, and the lower pivot block 500 which attaches to the base plate 100 are not shown in FIG. 8 in order to more clearly illustrate the operation of the pivot plate 200 and the strings 805. The base plate 100 is pivotally connected to the pivot plate 200 via a hinge at knuckle 203. The base plate 100 includes stirrup-shaped hinge knuckles 105 (shown in FIG. 1A) with gauged rollers 400 inserted between adjacent stirrup-shaped hinge knuckles 105 and aligned at the hinge's pivot axis (121, shown in FIG. 1A). The string seat 300 is inserted into the keyed channel 205 in the pivot plate 200 and is longitudinally adjustable to provide a second intonation adjustment at the tremolo device 800 in addition to the intonation adjustment at the bridge mounted on bridge mount section 113.

The string 805 is threaded through the opening of the string seat 300 until the ball or ring 311 at the end of the string seats within the tapered opening 305 of the string seat 300. The string is then directed downward, assisted by the string deflector 213, under the second set of gauged rollers 400" which are aligned with the pivotal axis between the base plate 100 and the pivot plate 200. The string is then directed over the first set of gauged rollers 400' at the bridge saddle 700 and extends along the neck of the guitar to the nut. In this way, three segments of the string 805 are defined. A first segment 810 between the string seat and the second set of rollers 400" at the hinge, a second segment 820 between the second set of gauged rollers 400" at the hinge and the first set of gauged rollers 400' at the bridge mounted on bridge mount section 113, and a third segment 830 extending from the bridge mounted on bridge mount section 113 to the nut at the headstock.

When the string 805 is installed and tightened at the tuning peg, the tension placed on the string 805 will be transmitted through the third string segment 830 through the second string segment 820 to the string seat 300 via the first string segment 810. The string 805 pulls the string seat 300 downward through the leverage created by the string 805 passing over the bridge saddle 700 first set of rollers 400' and under the second set of rollers 400" corresponding to the hinge. The rollers 400 act like a pulley, to provide a tensile force on the string seat 300, which pulls it downward toward the body 803 of the guitar along with the pivot plate 200, which is coupled to the string seat 300. A spring 807 provides a counteractive force to hold the pivot plate 200 up against the force of the string tension. The spring 807 is seated between the base plate 100 and the pivot plate 200 and serves to maintain the tremolo device 800 position in an unused state. During use, the user applies a downward force on the pivot plate 200 which pivots relative to the base plate 100 at the hinge in a direction indicated by arrow 850. A tremolo arm is provided to give the player sufficient leverage to pivot the pivot plate 200 against the counterforce of the spring 807.

As the pivot plate 200 is pivoted in the direction indicated by arrow 850, the string seat 300 is moved in a direction toward the bridge mounted on bridge mount section 113 effectively shortening the length of the string 805. The rollers 400" at the hinge and the rollers 400' at bridge saddles 700 allow the strings to move across their contact points with minimal friction, and each roller 400 is provided with a groove specifically suited for the diameter of the string 805. In this way, each string 805 in the set of strings stays in tune as the tremolo device 800 is used. By reducing friction, the strings can return to their original position more easily, thereby keeping the strings in tune. In addition, the gauged rollers 400 are adapted to each string and provide an even force across all strings. That is, the force applied by the pivot plate does not vary due to the gauge of the strings, as is the case of a fixed bridge saddle where the strings are slid across a fixed contact point.

The spring 807 returns the pivot plate 200 to its original position and each string 805 returns in tune. The spring 807 returns the pivot plate 200 to a predetermined position to ensure the guitar is returned to perfect tune. Thus, according to the embodiment of FIG. 8, the pivot plate 200 only moves in one direction from the home position, as indicated by arrow 850. In this way, the string 805 is only shortened, or tension decreased, in order to bring the string 805 to a lower pitch. The spring 807 then returns the pivot plate 200 to its exact original position to maintain tuning. When the player wishes to increase the pitch of a string 805 from its original tuning, methods other than the tremolo device 800 may be used, such as fretting, or "bending" the strings.

Figure 9A:
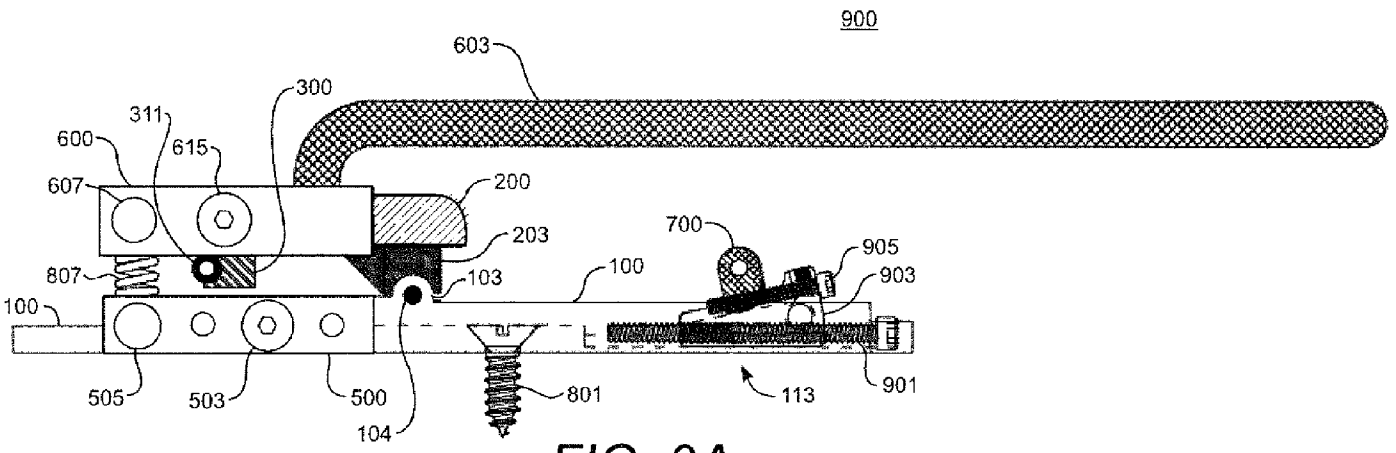
FIG. 9A is an elevation view of a tremolo and bridge device in an un-deployed state according to an embodiment of the invention.
Figure 9B:
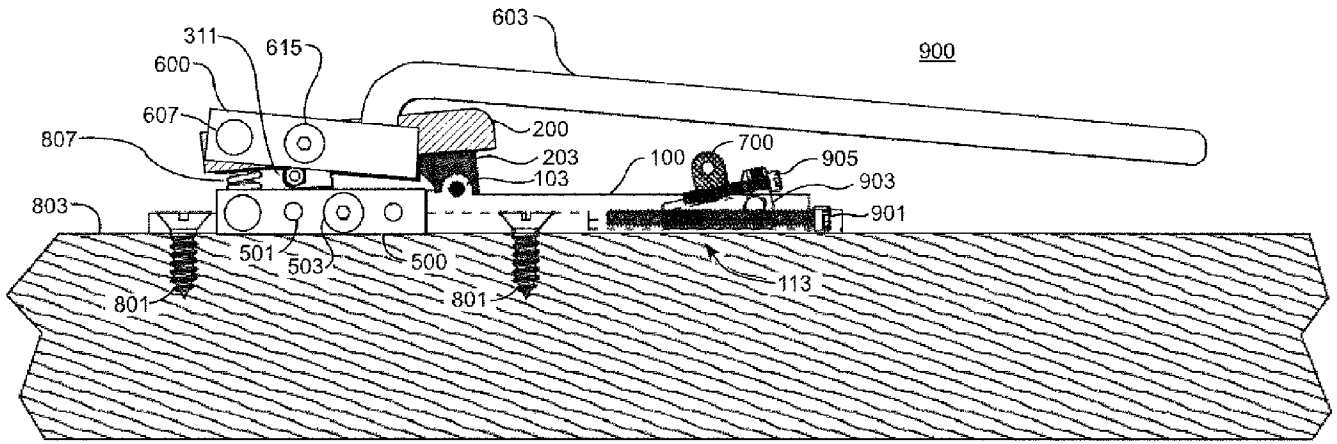
FIG. 9B is an elevation view of a tremolo and bridge device in a deployed state according to an embodiment of the invention.

Referring now to FIG. 9A and FIG. 9B, operation of the tremolo device according to an embodiment of the disclosure will now be described. FIG. 9A shows a tremolo device 900 according to an embodiment of this disclosure. The tremolo device 900 is shown in a non-deployed state, or home position, in FIG. 9A. FIG. 9B shows the tremolo device 900 in a deployed state, where the player of the instrument has applied force to the tremolo arm 603 to actuate the tremolo device 900. Base plate 100 is mounted to a surface of the instrument body 803 by wood screws 801. Lower pivot block 500 is attached to a sidewall of the base plate 100 via dowel or pin apertures 501 and mounting screw via threaded aperture 503. Bearing 505 is slip mounted into a hole defined in the lower pivot block 500 and receives a compensating screw (not shown) through a threaded aperture defined in the bearing 505 perpendicular to its longitudinal axis. The compensating screw connects the bearing 505 in the lower pivot block 500 to bearing 607 disposed in an aperture 608 defined in upper pivot block 600. Bearing 505 and 607 are slip fitted into their corresponding apertures such that they rotate within the aperture without producing vibration. According to an embodiment, bearing 505 is configured to have a threaded aperture defined through the bearing, having a left-hand thread configuration, while the bearing 607 in the upper pivot block 600 has a right-hand thread configuration. In this embodiment the compensating screw, which couples bearing 505 and bearing 607, may be used to adjust the height of upper pivot block 600 relative to the instrument body 803 by rotating the compensating screw. Due to the opposing thread configuration, a turn of the compensating screw produces double the adjustment as the upper pivot block 600 bearing 607 traverses the threaded compensating screw, while the end of the compensating screw which engages the left-hand thread of the lower pivot block 500 bearing 505, raises the upper pivot block as the compensating screw is rotated within the left-hand threaded bearing 505.

Upper pivot block 600 receives the tremolo arm 603 on a surface opposite the body 803 of the instrument. On an adjacent surface of upper pivot block 600 facing the player of the instrument, upper pivot block 600 is pivotally coupled to the pivot plate 200 by shouldered screw 615 via mounting hole 609 in the upper pivot block 600. The pivot plate 200 is pivotally coupled to the base plate 100 by a hinge defined by hinge knuckle 103 in the base plate 100 and hinge knuckle 203 of the pivot plate 200. Aligned with the pivot axis defined by hinge knuckles 103, 203, a set of gauged rollers (400, shown in FIG. 4) are inserted between the hinge knuckles 103 corresponding to the string locations. String seat 300 is adjustably coupled to the pivot plate 200 via a keyed slot (205, shown in FIG. 2). The string 805 passes through a hole 307 defined in the string seat 300 and passes under the gauged rollers (400", shown in FIG. 8) at the hinge between the pivot plate 200 and the base plate 100. The string 805 then extends upward and over a set of gauged rollers (400', shown in FIG. 8) associated with the bridge saddles 700 at the bridge assembly mounted on bridge mount section 113.

As shown in FIG. 9B, to use the tremolo device 900, a player moves the tremolo arm 603 toward the body 803 of the instrument. This causes the upper pivot block to rotate in a clockwise direction as shown in FIG. 9B, as bearings 607 in the upper pivot block 600 and bearing 505 in the lower pivot block 500 rotate to accommodate movement of the upper pivot block which pivots about shouldered screw 615. As upper pivot block 600 rotates, downward force is placed on pivot plate 200, which is coupled to the upper pivot block 600 by shouldered screw 615. As the pivot plate 200 is directed downward, the pivot plate 200 pivots about the hinge 203 and compresses spring 807. The pivoting of the pivot plate 200 causes the string seat 300 to move in a direction toward the bridge assembly mounted on bridge mount section 113, decreasing the tension on string 805 and thereby reducing its pitch. The string 805 slides easily over gauged rollers (400', 400", shown in FIG. 4) at the hinge 103, 203, and the bridge saddle 700 to reduce friction on the string. Each roller 400 includes a groove 401 matching the string gauge of its associated string. This allows for each string to stay in tune in response to the force distributed by the pivot plate 200 to all the strings causing them to move relative to the bridge saddle 700.

When the player releases pressure on the tremolo arm 603, compressed spring 807 produces an upward force on pivot plate 200, urging the pivot plate 200 back to its original position shown in FIG. 9A. Spring 807 returns the pivot plate 200 to its exact original position due to the coupling of the upper pivot block 600 to the lower pivot block by the compensating screw (not shown). By providing each string with a low friction path via the gauged rollers, and insuring the string is returned to its exact original position, all the strings are kept in tune as the tremolo device 900 is released.

Figure 7C:
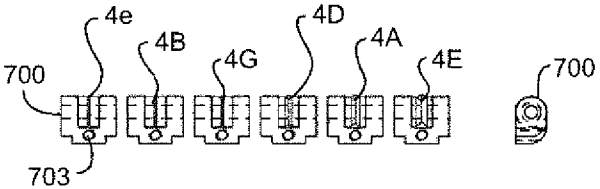
FIG. 7C is a front elevation view of a set of bridge string saddles of FIG. 1, associated with a gauged roller at the string contact point of the string saddle of a bridge assembly according to an embodiment of the invention.

As may be seen in FIG. 9A and FIG. 9B, the bridge assembly mounted on bridge mount section 113 may include bridge saddle 700 which receives a set of gauged rollers 400 as described with respect to FIG. 7. The bridge saddle 700 includes a threaded aperture 703 defined through the saddle 700, which receives a height adjustment screw 905. Rotation of the height adjustment screw 905 causes the bridge saddle 700 to slidably traverse an intonation bridge element 903 via a keyed slot or channel in the intonation bridge element 903. The intonation bridge element 903 has a sloped upper surface, which receives the bridge saddle 700. As the bridge saddle 700 traverses the sloped upper surface, the bridge saddle 700 and its associated gauged roller 400 raise or lower with the contour of the sloped upper surface providing height adjustment of the string 805 at its contact point with the gauged roller 400. The intonation bridge element 903 engages channel (115, shown in FIG. 1) and is movable longitudinally along the path of the string 805. An intonation adjustment screw 901 engages a threaded aperture defined longitudinally through the intonation bridge element 903, such that rotation of the intonation adjustment screw 901 causes the intonation bridge element 903 to move along channel 115, providing harmonic tuning of the string 805 by adjusting the string's length between the bridge and the nut.

The preceding description is directed to certain embodiments of a tremolo device. While the configurations shown, and specific parts described may be used to produce the described embodiments. Persons of skill in the relevant art may, upon reading this description, envision various configurations and substitutions of parts, which would fall within the intended scope of this description. Thus, other embodiments may be contemplated that while not literally described herein, would nevertheless fall within the scope of this disclosure. Accordingly, the invention should be limited by the accompanying description, and is to be defined by the language provided in the accompanying claims.

What is claimed is:

1. A tremolo device for a stringed instrument, comprising:

a base plate configured for surface mounting to a body of the instrument;

a pivot plate pivotally coupled to said base plate proximal to an edge of said pivot plate;

a string seat configured to receive a string of the instrument and having a tapered notch into which a terminal end of the string is seated, and a keyed portion configured for slidably attaching said string seat to said pivot plate by engaging said keyed portion with a keyed slot in said pivot plate;

a spring disposed between said base plate and said pivot plate, said spring configured to maintain said pivot plate in a first position relative to said base plate until a user action pivots said pivot plate relative to said base plate, and to return the pivot plate to the first position when the user action is terminated.

2. The tremolo device of claim 1, further comprising:

an upper pivot block coupled to said pivot plate;

a lower pivot block coupled to said base plate;

wherein said upper pivot block is configured to receive a tremolo arm, said tremolo arm operative to provide a user with leverage to pivot said pivot plate relative to said base plate.

3. The tremolo device of claim 2, wherein said upper pivot block is configured with an aperture for receiving said tremolo arm, and wherein said tremolo arm has a circumferential groove about a shaft of said tremolo arm, that when said tremolo arm is inserted into said aperture in said upper pivot block, said circumferential groove is within said aperture, and wherein said upper pivot block has a second aperture, perpendicular to said first aperture, said second aperture configured to receive a set screw, said set screw preventing said tremolo arm from pulling out of said first aperture while allowing said tremolo arm to rotate within said first aperture.

4. The tremolo device of claim 2, further comprising:

a compensating screw configured to couple said upper pivot block and said lower pivot block, said compensating screw being threaded through a first bearing inserted in said upper pivot block and a second bearing inserted in said lower pivot block.

5. The tremolo device of claim 4, wherein said compensating screw is configured to be threaded in a first thread direction at said first bearing and in a second thread direction opposing said first thread direction at said second bearing.

6. The tremolo device of claim 1, said base plate comprising:

a bridge mounting section configured to receive a bridge assembly between said pivot plate and a neck of the stringed instrument.

7. The tremolo device of claim 6, wherein said bridge mounting section further comprises at least one keyed slot configured to receive a string saddle corresponding to one string of the stringed instrument.

8. The tremolo device of claim 7, wherein said string saddle comprises:

a first member configured to receive a gauged roller, said gauged roller having a rotational axis perpendicular to a direction of the corresponding string and having a groove about its perimeter, said groove having a size configured to receive the corresponding string and having a keyed section; and a second member having a keyed slot configured to receive said keyed section of said first member and slidingly engage said first member, said second member having a sloped surface at said keyed slot, wherein upon the first member sliding along said keyed slot causes a height of said string saddle relative to said base plate to change.

9. The tremolo device of claim 1, further comprising:

an intonation adjustment screw configured to be threadingly engage through said keyed portion of said string seat and disposed longitudinally within said keyed slot of said pivot plate, wherein turning said intonation adjustment screw causes said string seat to slide along the longitudinal axis of said intonation adjustment screw along said keyed slot.

10. The tremolo device of claim 1, further comprising:

a plurality of gauged rollers, each gauged roller corresponding to one string of the stringed instrument, the plurality of gauged rollers having a rotational axis aligned with a pivot axis between said pivot plate and said base plate, wherein a string of the stringed instrument extends from an associated string seat under said corresponding gauged roller, said corresponding gauged roller having a groove about its perimeter, said groove having a size configured to receive the string and based on the gauge of the associated string.

11. The tremolo device of claim 1, wherein said stringed instrument is a guitar and said pivot plate is configured to receive six string seats.

12. A stringed instrument comprising:

a body;

a neck attached to said body;

a nut at an end of said neck, opposite said body;

a headstock attached to said neck at said nut, said headstock including tuner pegs for receiving a terminal end of a string;

a bridge defining a second terminal end of the string, said bridge being positioned on said body; and a tremolo device positioned between said bridge and said second terminal end of the string, wherein said tremolo device further comprises:

a base plate configured to be surface mounted on said body;

a pivot plate pivotally attached to said base plate at a lateral edge of said pivot plate along a pivot axis;

a string seat configured to receive a string of the stringed instrument having a tapered notch into which a terminal end of the string is seated, and a keyed portion configured for slidably attaching said string seat to said pivot plate by engaging said keyed portion with a keyed slot in said pivot plate; and a spring positioned between said pivot plate and said base plate to maintain a fixed position of said pivot plate relative to said base plate when said tremolo device is not in use.

13. The stringed instrument of claim 12, said tremolo device further comprising:

an upper pivot block coupled to said pivot plate;

a lower pivot block coupled to said base plate, wherein said upper pivot block is configured to receive a tremolo arm, said tremolo arm operative to provide a user with leverage to pivot said pivot plate relative to said base plate.

14. The stringed instrument of claim 13, said tremolo device further comprising:

a compensating screw configured to couple said upper pivot block and said lower pivot block, said compensating screw being threaded through a first bearing inserted in said upper pivot block and a second bearing inserted in said lower pivot block.

15. The tremolo device of claim 14, wherein said compensating screw is configured to be threaded in a first thread direction at said first bearing and in a second thread direction opposing said first thread direction at said second bearing.

16. The stringed instrument of claim 12, said base plate comprising:

a bridge mounting section configured to receive said bridge between said pivot plate and said neck of the stringed instrument.

17. The stringed instrument of claim 16, said bridge mounting section further comprising:

at least one keyed slot configured to receive a string saddle corresponding to one string of the stringed instrument.

18. The stringed instrument of claim 17, wherein said string saddle comprises:

a first member configured to receive a gauged roller, said gauged roller having a rotational axis perpendicular to a direction of the corresponding string and having a groove about its perimeter, said groove having a size configured to receive the corresponding string and having a keyed section; and a second member having a keyed slot configured to receive said keyed section of said first member and slidingly engage said first member, said second member having a sloped surface at said keyed slot, wherein upon the first member sliding along said keyed slot causes a height of said string saddle relative to said base plate to change.

19. The tremolo device of claim 12, said tremolo device further comprising:

an intonation adjustment screw configured to be threadingly engage through said keyed portion of said string seat and disposed longitudinally within said keyed slot of said pivot plate, wherein turning said intonation adjustment screw causes said string seat to slide along the longitudinal axis of said intonation adjustment screw along said keyed slot.

20. The stringed instrument of claim 12, said tremolo device further comprising a plurality of gauged rollers, each gauged roller corresponding to one string of the stringed instrument, the plurality of gauged rollers having a rotational axis which is aligned with a pivot axis between said pivot plate and said base plate, wherein a string of the stringed instrument extends from an associated string seat under said corresponding gauged roller, said corresponding gauged roller having a groove about its perimeter, said groove having a size configured to receive the string and based on the gauge of the associated string.

* * * * *